US007261653B2

(12) United States Patent
Thornburg et al.

(10) Patent No.: US 7,261,653 B2
(45) Date of Patent: Aug. 28, 2007

(54) GOLF SWING TRAINING APPARATUS

(76) Inventors: Daniel C. Thornburg, 7529 Roberts Street, NE., Albuquerque, NM (US) 87109-4960; Brian D. Thornburg, 7529 Roberts Street, NE., Albuquerque, NM (US) 87109-4960

( * ) Notice: Subject to any disclaimer, the term of this patent is extended or adjusted under 35 U.S.C. 154(b) by 0 days.

(21) Appl. No.: 11/229,890

(22) Filed: Sep. 16, 2005

(65) Prior Publication Data

US 2006/0063602 A1 Mar. 23, 2006

Related U.S. Application Data

(60) Provisional application No. 60/610,335, filed on Sep. 16, 2004.

(51) Int. Cl.
*A63B 69/36* (2006.01)

(52) U.S. Cl. ..... 473/409; 473/266

(58) Field of Classification Search ..... 473/266, 473/268, 269–277, 218, 207, 409; 434/252
See application file for complete search history.

(56) References Cited

U.S. PATENT DOCUMENTS 4,699,384 A * 10/1987 Bechler et al. ..... 473/264
4,718,674 A * 1/1988 Henry ..... 473/218
4,993,716 A * 2/1991 Waller ..... 473/275
5,005,836 A * 4/1991 Nelson ..... 473/229
5,013,044 A * 5/1991 Hesselbart ..... 473/218
5,303,926 A * 4/1994 Owens et al. ..... 473/261
5,599,240 A * 2/1997 Feldmeier ..... 473/218
5,616,085 A * 4/1997 LaCoste et al. ..... 473/267

* cited by examiner

*Primary Examiner*—Nini F. Legesse
(74) *Attorney, Agent, or Firm*—Vidal A. Oaxaca; Peacock Myers, P.C.

(57) ABSTRACT

The present invention provides a training apparatus and method for improving the stance of a golfer throughout the golfer's swing. The apparatus comprises a shaft pivotally connected to a base so that the shaft pivots about a pivot point along a plane to increase or decrease the angle formed by the base, the shaft, and the pivot point. A golfer stands on the base and straddles the shaft so that the leading foot is behind the shaft nearest the pivot point, and the non-leading leg is in front of the shaft thus preventing an over-rotation of a golfer's hips during the performance of a back swing and keeping the golfer's arms in front of the golfer's chest so that the golf club does not become trapped behind the golfer.

1 Claim, 4 Drawing Sheets

GOLF SWING TRAINING APPARATUS

CROSS-REFERENCE TO RELATED APPLICATIONS

This application claims the benefit of the filing of U.S. Provisional Patent Application Ser. No. 60/610,335, entitled "Golf Swing Training Aid", filed on Sep. 16, 2004, and the specification of that application is incorporated herein by reference.

BACKGROUND OF THE INVENTION

1. Field of the Invention (Technical Field)

The present invention relates to a training device for improving a golfer's swing.

2. Description of Related Art

Note that the following discussion refers to a number of publications by author(s) and year of publication, and that due to recent publication dates certain publications are not to be considered as prior art vis-a-vis the present invention. Discussion of such publications herein is given for more complete background and is not to be construed as an admission that such publications are prior art for patentability determination purposes.

In golf, a player's stance is important to ensure for an optimal swing. The golfer's stance through the swing is so important that considerable attention is given to the stance both during initial training and throughout the golfer's development.

Although there are numerous devices available to improve a golfer's swing, there remains a need to improve the swing by focusing on the golfer's stance throughout the swinging motion.

BRIEF SUMMARY OF THE INVENTION

The present invention provides a golf training apparatus and method. An embodiment of the apparatus comprises a substantially flat base, a shaft pivotally connected from an end of the shaft to a pivot point at the base to permit movement of the shaft about the pivot point along a plane for varying an angle defined by a longitudinal axis of the base and a longitudinal axis of the shaft, the shaft having a length along the longitudinal axis of the shaft of at least approximately 14 inches, wherein the shaft is placeable against a front of a leading leg of a golfer proximal to the pivot point and against a back of a non-leading leg of the golfer while the golfer stands on the base.

The base and shaft are of sufficient length to accommodate a golfer's stance including, but not limited to, a length along the longitudinal axis of the base of from between approximately 14 and 40 inches, and wherein the shaft has a length along the longitudinal axis of the shaft of from between approximately 14 and 40 inches. The shaft preferably comprises an average diameter of at least 0.3 inches. The base preferably comprises an average width of from between approximately 3 and 5 inches. Preferably, the length of the shaft is adjustable. The shaft preferably comprises a padding material at an area of the shaft proximal to the pivot point.

In an embodiment, the apparatus further comprises a structure at the pivot point to prevent the shaft from pivoting along a horizontal plane.

In another embodiment, the apparatus further comprises a column connected from an end to the base, and in which the pivot point is located.

In another embodiment, the pivot point is located in the column at a distance of from between approximately 1.5 and 4.0 inches from the base.

Another embodiment provides a method comprising providing a substantially flat base, pivotally connecting a shaft having a length along the longitudinal axis of the shaft of at least approximately 14 inches from an end of the shaft to a pivot point at an end of the base to permit movement of the shaft about the pivot point along a plane for varying an angle defined by a longitudinal axis of the base, a longitudinal axis of the shaft, and the pivot point, placing the shaft against a front of a leading leg of a golfer proximal to the pivot point and against a back of a non-leading leg of the golfer as the golfer stands on the base, and preventing over-rotation of the golfer's hips as the golfer executes a back-swing.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into, and form a part of, the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

The present invention provides a training apparatus and method for improving the stance of a golfer throughout the golfer's swing. As used herein, "a" and "an" mean one or more.

An embodiment of the present invention provides an apparatus comprising a shaft pivotally connected to a base. The base is preferably substantially flat. The connection is such that the shaft pivots about a pivot point along a plane to increase or decrease the angle formed by the longitudinal axis of the base and the longitudinal axis of the shaft. In use, a goiter stands on the base and places an end of the shaft, proximal to the pivot, in front of the leading leg (i.e. the leg toward the golf ball's anticipated direction of flight) at an opposite end behind the non-leading, other leg. The means or structure of connection between the shaft and the base preferably restricts or eliminates lateral movement of the shaft as a golfer rotates to swing a golf club.

The golf training apparatus/aid of the present invention prevents an over-rotation of a golfer's hips during the performance of a back swing. In preventing an over-rotation of the hips, the invention creates a wider gap between the golfer's hip turn and the golfer's shoulder turn. This results in an improved motion that creates more distance through a better coil given that the more a golfer can keep his/her hip from turning while simultaneously allowing the shoulders to turn as much as possible and as needed. Thus, the aforementioned gap and coil for power is created. In addition to preventing a golfer's hips from over-rotating, the invention keeps the golfer's arms in front of the golfer's chest so that the golf club does not become trapped behind the golfer, which often produces off-line shots. Keeping the golfer's arms in front of the chest produces more solid, straighter shots.

Further, an over-rotation of the hips can create what is referred to as a "reverse pivot". A reverse pivot results when the leg that is being restricted straightens and the upper body moves toward the target during the back swing (which leg is restricted depends on whether the golfer is taking a right or left-handed stance). This reverse pivot motion creates an over-the-top move or motion of the hands. Compensating in this manner is a common flaw in the swing of many golfers. The present invention helps to prevent the defects noted above in golfers' swings and thus helps to accomplish a more reliable and powerful golf swing.

Figure 1:
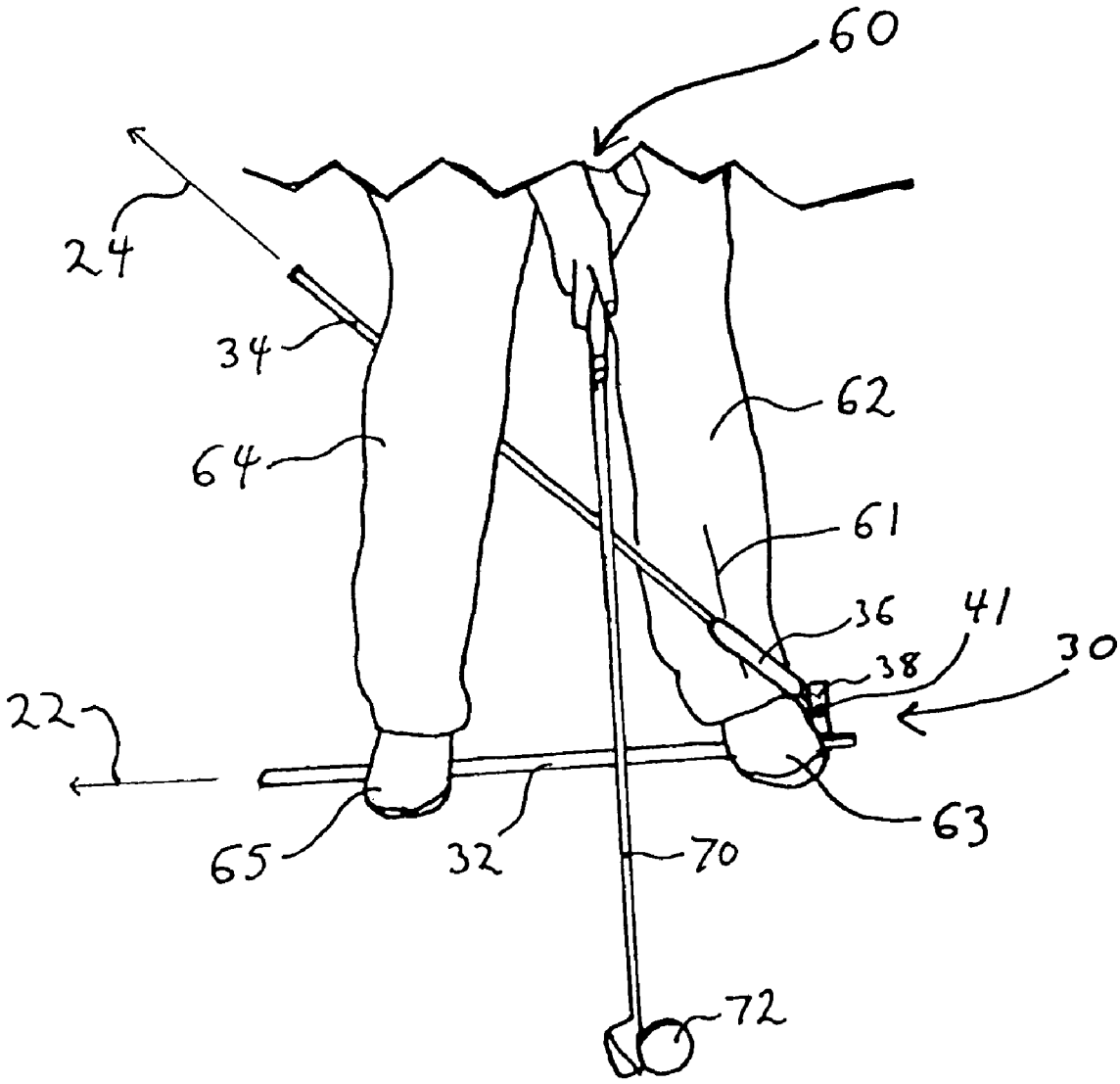
FIG. 1 is a front view of an embodiment of the present invention as used by a golfer prior to taking a backswing.

Turning now to the figures, which describe an embodiment of the present invention, FIG. 1 shows apparatus 30 comprising base 32 attached (in a preferably fixed manner) to column 38. Shaft 34 is pivotally connected to column 38 so that the angle between shaft 34 and base 32 is adjustable to fit golfers of different dimensions. Also, the length of shaft 34 is adjustable through any means known in the art such as, for example, telescoping means. It should be noted that an important feature of the invention is that shaft 34 is pivotally attached to base 32 and that any means known in the art for accomplishing that relationship may be utilized. In the preferred embodiment described herein, column 38 is provided as an interface for that connected relationship. Also, the connected relationship between shaft 34 and base 32 is accomplished by any means or fastener known in the art that, while allowing shaft 34 to pivot, preferably holds shaft 34 in a given position unless moved by the user from that position. An embodiment providing for such a connection is described herein in reference to FIGS. 3 and 4. Also, it is understood that the present invention can be carried out so that base 32 is integral to, or is, the ground.

Therefore, column 38 is an example of a connecting structure that provides a point of pivot such as pivot point 41 for moving shaft 34 about pivot point 41 along one plane thereby varying the angle defined by longitudinal axis 22 of base 32 and longitudinal axis 24 of shaft 34. The embodiment therefore prevents lateral, or side-to-side, movement of shaft 34. Although column 32 is an example of such a structure, any connecting structure known in the art may be utilized in accordance with the present invention. Such a connecting structure may be attached, or be integral, to either base 32 or shaft 34. Such a connecting structure may, for example, simply comprise apertures (not shown) in an end of base 32 and an end of shaft 34 for inserting a pin (not shown) through the apertures to pivotally base 32 to shaft 34.

Figure 2:
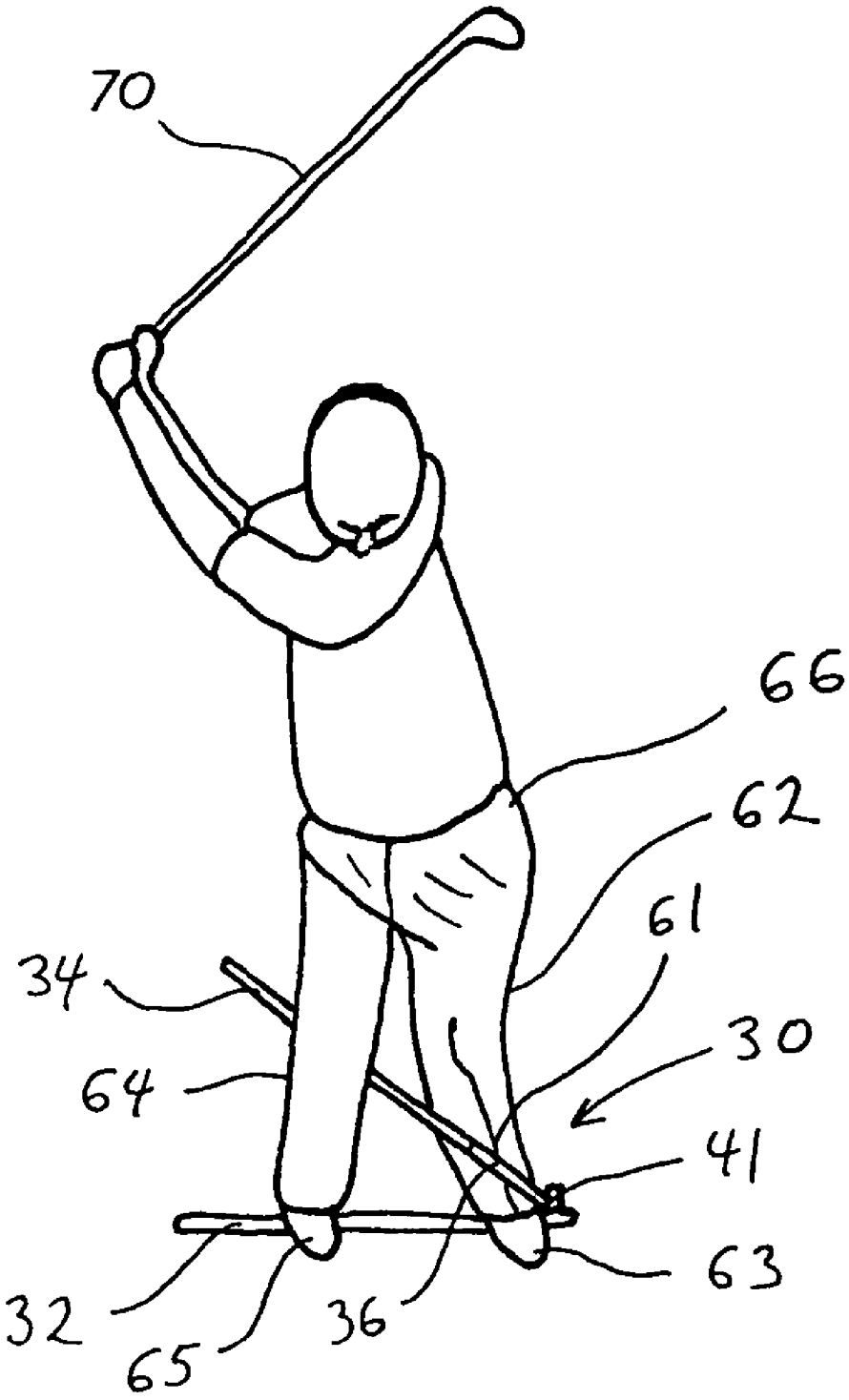
FIG. 2 is a front view of the embodiment shown in FIG. 1 with the golfer taking a backswing.

In practice, either left leg 62 or right leg 64 of golfer 60 is placed on base 32 behind, and against, shaft 30 nearest column 38. The choice of which leg to place in that position depends on whether golfer 60 will take a left-handed or a right-handed stance. In FIGS. 1 and 2, golfer 60 is shown placing left leg 62 near column 38 to take a right-handed swing of golf club 70 against golf ball 72. As such, left leg 62 is the "leading leg" in FIGS. 1 and 2, and it is understood that this is the leg facing toward the direction golf ball 72 will travel and that the opposite leg is the "non-leading leg". Pad 36 is preferably disposed on shaft 34 near pivot point 41 to cushion shaft 34 against leg 62 (or leg 64). Right leg 64 (i.e., the non-leading leg) is positioned so that shaft 34 is pressed against leg 64 behind the knee of leg 64.

Figure 3:
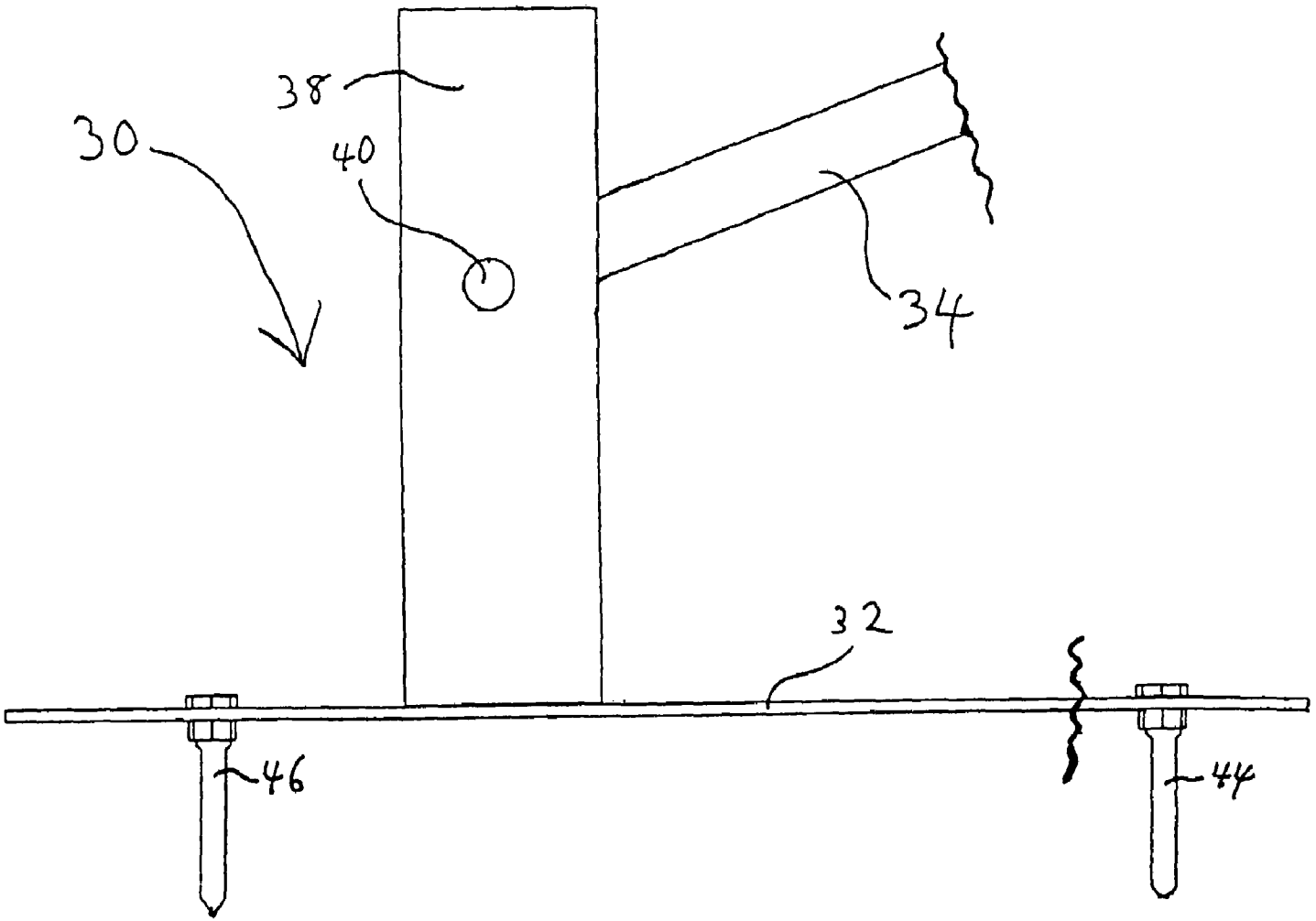
FIG. 3 is a side view of the embodiment of FIG. 1.

FIG. 3 shows in detail an embodiment in which shaft 34 is inserted into, and pivotally attached to, column 38. Column 38 is preferably fixed onto base 32. Base 32 may have anchors 44 and 46 to help secure base 32 to the ground (ground not shown). Any means known in the art may be used to secure base 32 to the ground, and an example is provided in FIG. 3 wherein anchors 44 and 46 are fixed, or removably attached, to base 32. In another embodiment, no pins are used, but as described below, the dimensions of base 32 provide for stability during use.

Figure 4:
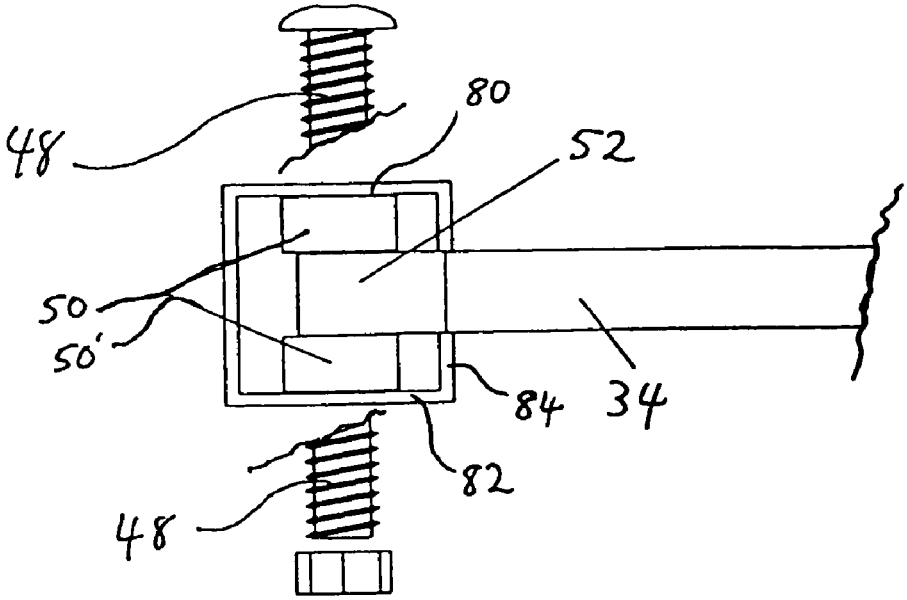
FIG. 4 is a top view of the column to which the shaft and base attach.
Figure 5:
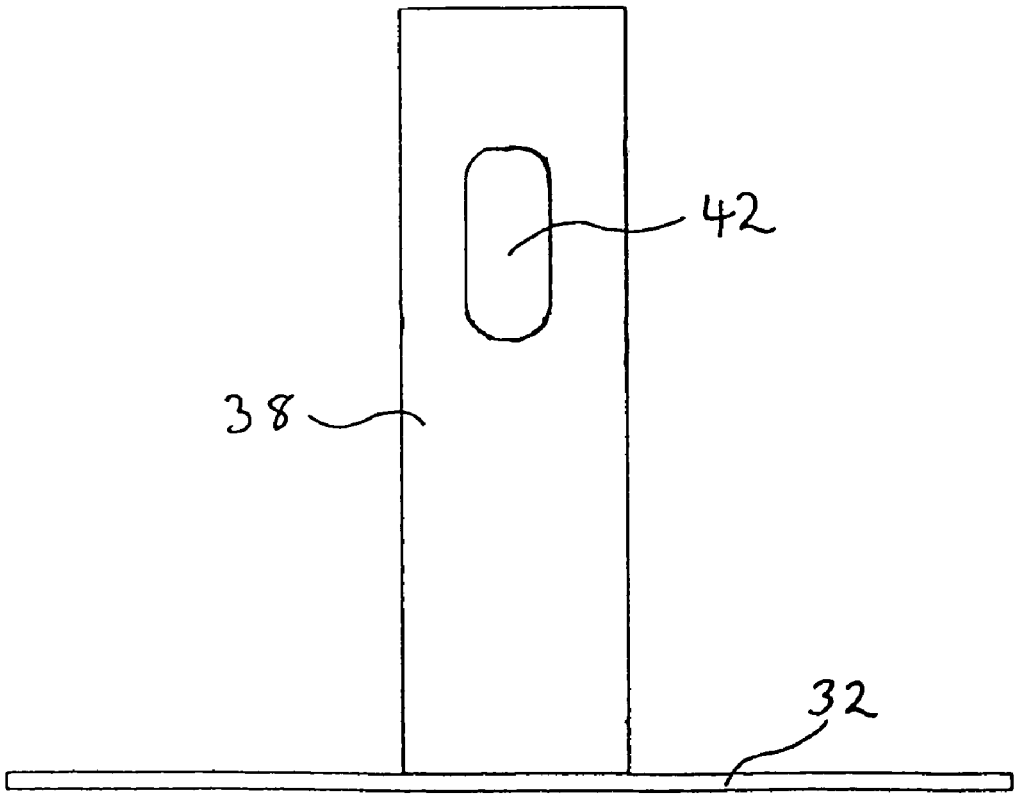
FIG. 5 is a front view of the column of FIG. 3.

Any means known in the art may be utilized to attach shaft 34 to column 38. In one embodiment, as shown in FIG. 4, a pin such as screw 48 is utilized and spacers 50, 50' are disposed between side walls 80, 82 and shaft 34. Screw 48 is inserted through hole 40 (shown in FIG. 3) in wall 82 of column 38, through another hole (not shown) in opposite wall 80, and through connector 52 which is attached to shaft 34. FIG. 5 shows opening 42 in wall 84 of column 38 through which shaft 34 is inserted. Opening 42 is of sufficient length to allow the pivoting movement of shaft 34 when the angle between shaft 34 and base 32 is adjusted.

Spacers 50, 50' may be made of any material known in the art suitable for use as spacers such as, for example, nylon. Pad 38 may be made of any material known in the art such as, for example, a foam material.

Base 32, anchors 44, column 38, and screw 48 may be made of any rigid material known in the art including, but not limited to, metal such as steel or aluminum. Base 32 is of sufficient length to allow golfer 60 to place legs 62 and 64 within the span of the length of base 32, and shaft 34 is of sufficient length to span the distance between legs 62 and 64. Shaft 34 also may be made of any material known in the art that is strong enough to constrain golfer 60 in the desired stance. Some flexibility may, but need not, be provided to help the upper body (not shown) of golfer 60 to fully rotate while preventing the hips (not shown) of golfer 60 from over-rotating; thus, apparatus 30 may function like a spring.

Shaft 34 may be made of any rigid material such as, but not limited to, a metal such as tubular stainless steel.

To provide for stability, and as an alternative to using anchors, base 32 comprises a sufficient area to provide a stable platform on which the golfer may stand. The area may therefore be large to provide such a stable platform, or, preferably, the dimensions of base 32 are such that the golfer's foot straddles a width of base 32 so that a front and a rear of the golfer's foot makes contact with the ground.

An embodiment exemplified by the figures (but without the use of anchors) provides, therefore, the following: (1) a base between approximately 14 and 40 inches long and between approximately 3 and 5 inches wide; (2) a shaft between approximately 14 and 40 inches long and with an average diameter of between approximately 0.3 and 2 inches; (3) a foam pad disposed at the end of the shaft proximal the pivot point; (4) a column connected to the base with a width of between approximately 0.8×0.8 and 1.5×1.5 inches and a length (height) of between approximately 2.0 and 5.0 inches; (5) a screw hole of between approximately 1.0 and 3.0 inches in diameter, the center of which is located from between approximately 1.0 and 4.5 inches from the base; (6) an opening for receiving the shaft into the column of between approximately 0.3 and 2.1 inches wide and between approximately 0.5 and 2.0 inches in length, the bottom of the opening being located between approximately 0.5 and 4.0 inches from the base; (7) spacers within the column of between approximately 0.1 and 0.5 inches in diameter; and (8) a screw connecting the shaft to the column.

Therefore, apparatus 30 helps increase the gap or measured difference between the rotation of the upper body and the hips of golfer 60. Ultimately, the purpose and result is that apparatus 30 helps to keep the shaft of club 70 on the correct plane during the backswing and to remain on plane through the downswing to produce a straighter ball 72 during flight.

In typical use, shown in FIGS. 1 and 2, golfer 60 places base 32 on the ground and pulls shaft 34 so that it pivots up to approximately a 45° angle. Golfer 60 then steps onto base 32 with foot 63 near pivot point 41 so that the end of shaft 34 proximal to pivot point 41 is firmly up against shin 61. Golfer 60 places foot 65 on the part of base 32 distal to pivot point 41 so that shaft 34 fits behind leg 64, behind the knee. Golfer 60 then takes golf club 70 back and apparatus 30 helps golfer 60 to make a better shoulder turn and keep the turn of hips 66 restricted (i.e., prevent over-rotation) so that as the backswing is completed, golfer 60 will be in the correct position to let the arms drop naturally. As club 70 comes down, it will be in an effective path to ball 72 so that the swing results in a square club face at impact and a solid hit

EXAMPLE

An apparatus in accordance with the description provided herein was constructed and used successfully as follows:

1. The spacers were approximately 0.250 inches in diameter and made of nylon.
2. The screw was a cap screw with nut and its dimensions were ¼×20.
3. The shaft was of approximately 0.370 inches in diameter and approximately 35.0 inches in length.
4. The width of the column was approximately 1.0×1.0 inches, and the length was approximately 3.5 inches.
5. The center of the screw hole was approximately 2.125 inches above the base and approximately 0.45 inches from the wall of the column furthest from the shaft. The hole's diameter was approximately 0.25 inch.
6. The opening for receiving the shaft into the column was approximately 0.375 inch wide and approximately 0.89 inch in length. The bottom of the opening was positioned approximately 1.96 inches from the base, and the top was positioned approximately 2.85 inches from the base.
7. A foam pad was disposed at the bottom (portion connected to the column) portion of the shaft to cushion the golfer's shin.
8. The length of the base was approximately 30 inches, and the width of the base was approximately 4 inches.

The preceding examples can be repeated with similar success by substituting the generically or specifically described compositions, biomaterials, devices and/or operating conditions of this invention for those used in the preceding examples.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A golf training method comprising:

providing a substantially flat base;

pivotally connecting an end of a shaft to a pivot point at an end of the base to permit movement of the shaft about the pivot point along a plane for varying an angle defined by the longitudinal axis of the base, the longitudinal axis of the shaft, and the pivot point;

placing the shaft against a front of a leading leg of a golfer proximal to the pivot point and against a back of a non-leading leg of the golfer as the golfer stands on the base; and the shaft preventing over-rotation of the golfer's hips as the golfer executes a back-swing.

* * * * *